US007918366B2

(12) United States Patent
Nielsen et al.

(10) Patent No.: US 7,918,366 B2
(45) Date of Patent: Apr. 5, 2011

(54) MULTIPLE DROP WEIGHT PRINTHEAD AND METHODS OF FABRICATION AND USE

(75) Inventors: Jeffrey A. Nielsen, Corvallis, OR (US); Craig A. Olbrich, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 883 days.

(21) Appl. No.: 11/519,666

(22) Filed: Sep. 12, 2006

(65) Prior Publication Data

US 2008/0062235 A1 Mar. 13, 2008

(51) Int. Cl.
*B67D 7/30* (2010.01)

(52) U.S. Cl. ..... 222/21; 222/14

(58) Field of Classification Search ..... 347/9, 12, 347/15, 40, 43, 44, 47, 56, 63
See application file for complete search history.

(56) References Cited

U.S. PATENT DOCUMENTS

| | | | | |
|---|---|---|---|---|
| 4,746,935 | A * | 5/1988 | Allen | 347/98 |
| 5,208,605 | A | 5/1993 | Drake | |
| 6,042,219 | A | 3/2000 | Higashino et al. | |
| 6,137,502 | A | 10/2000 | Anderson et al. | |
| 6,454,393 | B2 | 9/2002 | Chen et al. | |
| 6,481,819 | B2 | 11/2002 | Kaneko et al. | |
| 6,561,609 | B2 | 5/2003 | Bauer | |
| 6,656,432 | B1 | 12/2003 | Hirota et al. | |
| 6,908,183 | B2 | 6/2005 | Saksa | |
| 6,966,112 | B2 | 11/2005 | Kawamura | |
| 7,091,134 | B1 | 8/2006 | Meinhold | |
| 2003/0025750 | A1 | 2/2003 | Bauer | |
| 2003/0065294 | A1 | 4/2003 | Pickup et al. | |
| 2003/0184616 | A1 * | 10/2003 | Yang et al. | 347/47 |
| 2004/0155928 | A1 | 8/2004 | Clark | |
| 2004/0223015 | A1 * | 11/2004 | Couwenhoven et al. | 347/12 |
| 2005/0067503 | A1 | 3/2005 | Katase | |
| 2005/0134643 | A1 | 6/2005 | Cho et al. | |
| 2005/0168506 | A1 | 8/2005 | Keller et al. | |
| 2006/0001698 | A1 * | 1/2006 | Hart et al. | 347/40 |
| 2006/0007270 | A1 | 1/2006 | Kawamura | |
| 2006/0038851 | A1 | 2/2006 | Cornell et al. | |
| 2006/0050107 | A1 | 3/2006 | Yamanaka et al. | |
| 2006/0050110 | A1 | 3/2006 | Osada et al. | |
| 2006/0057503 | A1 | 3/2006 | Bertelsen et al. | |
| 2006/0061622 | A1 * | 3/2006 | Suzuki | 347/47 |
| 2006/0066690 | A1 | 3/2006 | Katayama | |

FOREIGN PATENT DOCUMENTS

| | | | |
|---|---|---|---|
| JP | 2005 238787 | A | 9/2005 |
| WO | 00/50111 | A | 8/2000 |
| WO | 01/17782 | A | 3/2001 |
| WO | 2004/049466 | A | 6/2004 |

OTHER PUBLICATIONS

Pending U.S. Appl. No. 11/495,241, Jeremy Harlan Donaldson et al., filed Jul. 28, 2006.

* cited by examiner

*Primary Examiner* — Matthew Luu
*Assistant Examiner* — Kendrick X Liu

(57) ABSTRACT

A printhead includes a chamber layer and at least two orifice layers. A first orifice layer is disposed on the chamber layer, and a second orifice layer is disposed on the first orifice layer. The second orifice layer has at least one counterbore formed therein. A first nozzle is formed through both orifice layers and produces droplets of a first drop weight. A second nozzle is formed through the first orifice layer, coincident with the counterbore, and produces droplets of a second drop weight that is different than the first drop weight. In one embodiment, the printhead is used in a stand-alone fluid-dispensing device.

13 Claims, 3 Drawing Sheets

MULTIPLE DROP WEIGHT PRINTHEAD AND METHODS OF FABRICATION AND USE

BACKGROUND OF THE INVENTION

Drop-on-demand and continuous jetting technologies have been used for many years to jet colorant onto various substrates for the purposes of printing documents, labels, digital photographs and the like. Inkjet printing technology is commonly used in many commercial products such as computer printers, graphics plotters, copiers, and facsimile machines. The small drops of fluid that can be achieved with inkjet technology make the technology desirable for other applications as well. Recently, there has been interest in using jetting technologies for the precision dispensing of high value materials. For example, inkjet technology could be used to dispense reagents, enzymes or other proteins into well-plates for the purpose of fluid mixing or initiating chemical reactions. Other examples of alternative applications include the printing of LCD color filters and transistor back-planes.

In a laboratory environment, it is useful to be able to accurately dispense small volumes of various fluids. Having a number of dispensers available with different dispensing geometries increases the likelihood of being able to achieve the desired drop volume or line width for a particular fluid. However, it is often unknown what drop volume will come out of a particular dispenser with a particular fluid (e.g., ethanol, water and toluene will all give different drop volumes from the same physical dispensing geometry). While it is possible to develop computational models (based on fluid-substrate interaction and drop volume size relative to fundamental fluid properties such as specific heat, heat of vaporization, boiling temperature, etc.) to predict drop volumes, the physics behind drop/substrate interaction and nucleation parameters for various fluids are complicated, and such models can be uncertain and fraught with errors. Accordingly, it is often easier and faster to determine the appropriate dispensing geometry empirically. This entails filling multiple dispensers with the particular fluid to determine which one provides the desired drop volume or line width. Filling multiple dispensers to empirically discover the proper geometry requires a relatively large amount of the fluid and is thus expensive when dealing with high-value fluids.

DETAILED DESCRIPTION OF THE INVENTION

Figure 1:
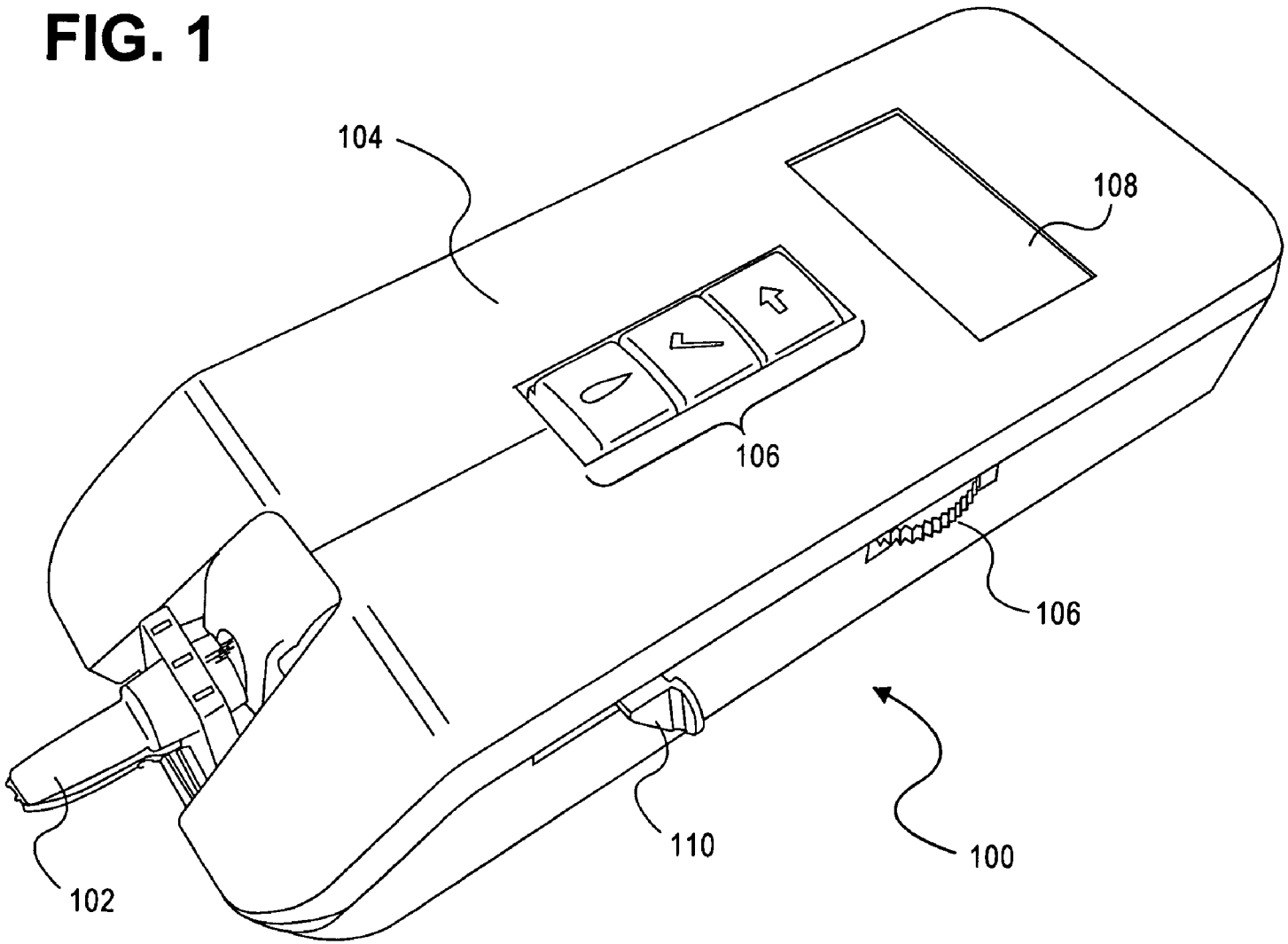
FIG. 1 is a perspective view of one embodiment of a handheld and/or mountable fluid-dispensing device.

Referring to the drawings wherein identical reference numerals denote the same elements throughout the various views, FIG. 1 shows a fluid-dispensing device 100, which, by way of example, can be used to accurately dispense small amounts of various fluids in a laboratory setting. The fluid-dispensing device 100 can be used in a handheld manner in that a user can easily hold it in place over a desired location with just one hand while dispensing one or more drops of fluid. Alternatively, the fluid-dispensing device 100 can be mounted to an appropriate positioning means, such as an X-Y carriage, for positioning the fluid-dispensing device 100 in a desired location. The fluid-dispensing device 100 can also be mounted to stationary objects.

The fluid-dispensing device 100 includes a disposable, interchangeable pen 102, from which one or more drops of fluid are ejected, and an enclosure 104, which supports the pen 102 and is the part of the device 100 that is handheld and/or mountable. The enclosure 104 may be fabricated from plastic or another type of material. The fluid-dispensing device 100 includes a user interface made up of a number of user-actuable controls 106 and a display 108. The controls 106 may include buttons and/or scroll wheels that are disposed within and extend through the enclosure 104, such that they are externally exposed as depicted in FIG. 1. The display 108 may be a liquid-crystal display (LCD), or another type of display, and is also disposed within and extends through the enclosure 104, such that it is externally exposed as well.

The display 108 presents information regarding the pen 102, among other types of information. The user is able to use the fluid-dispensing device 100 to eject fluid from the pen 102 via the controls 106, with informational feedback provided on the display 108. The fluid-dispensing device 100 can be used to eject fluid from the pen 102 on a stand-alone basis, that is, without the fluid-dispensing device 100 being connected to another device, such as a host device like a desktop or laptop computer, a digital camera, and so on.

The fluid-dispensing device 100 further includes an ejection control 110. User actuation of the ejection control 110 causes the pen 102 to be ejected from the fluid-dispensing device 100, without the user having to directly pull or pry the pen 102 from the device 100. In this way, if the pen 102 contains a caustic or other type of fluid with which user contact is desirably not made, it can be disposed of by simply positioning the fluid-dispensing device 100 over a proper waste receptacle and ejecting the pen 102 from the device 100 into the waste receptacle.

Figure 2:
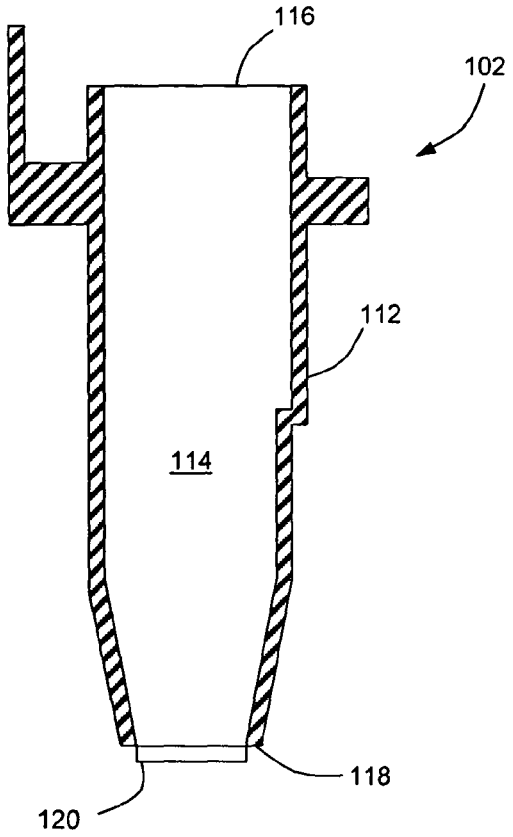
FIG. 2 is a cross-sectional view of one embodiment of a pen from the fluid-dispensing device of FIG. 1.

Referring to FIG. 2, the pen 102 includes a substantially hollow body 112 defining a chamber 114 that contains a supply of the fluid to be ejected. The body 112 may be fabricated from plastic or another material, and includes a first end 116 and a second end 118. In the illustrated embodiment, the body 112 tapers from the first end 116 to the second end 118. The pen 102 is connected to the enclosure 104 at the first end 116 and includes a fluid ejection device or printhead 120 situated or disposed at the second end 118 of the pen body 112, in fluid communication with the chamber 114. The printhead 120 generally includes a plurality of orifices or nozzles through which the drops are ejected. The pen 102 also includes an electrical connector (not shown) that electrically connects the printhead 120 with a controller (not shown) disposed inside the enclosure 104.

In general, the pen 102, via the printhead 120, is able to eject drops of fluid in the picoliter range, such as 500 picoliters or less. By comparison, conventional pipette technology, which is commonly employed to jet individual drops of fluid for fluid analysis and other purposes, can at best eject drops having volumes in the range of one microliter. As such, the fluid-dispensing device 100 is advantageous over conventional pipette technology for this application, because it can dispense fluids in drops that are approximately a million times smaller than conventional pipette technology. Newer pipette technology has been developed that can eject drops having volumes in the nanoliter range, but such devices are prohibitively expensive, and indeed the fluid-dispensing device 100 can still dispense fluids in drops that are approximately a thousand times smaller.

Figure 3:
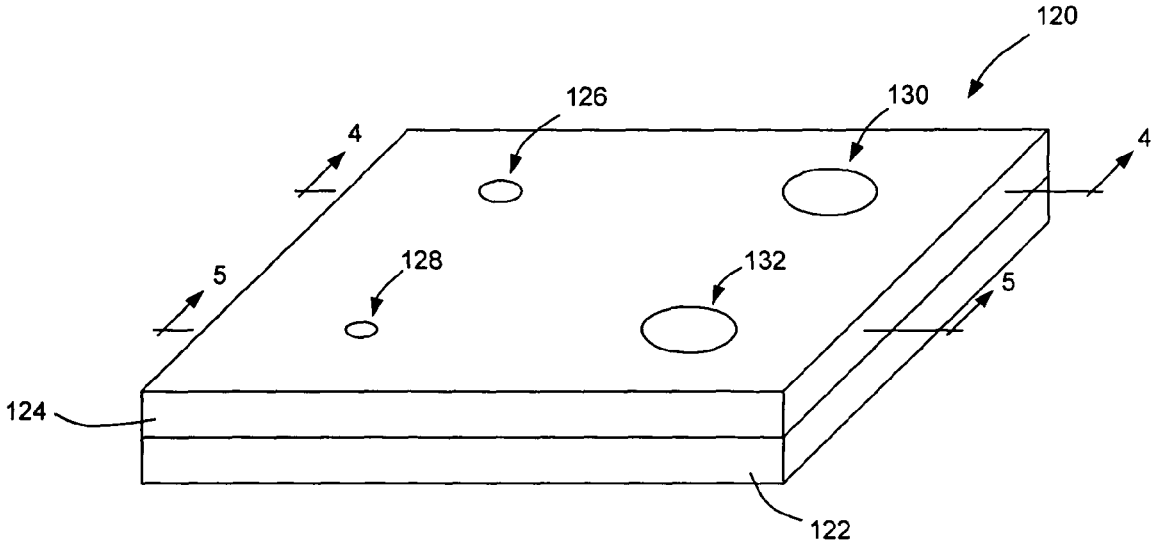
FIG. 3 is a perspective view of one embodiment of a printhead from the fluid-dispensing device of FIG. 1.
Figure 4:
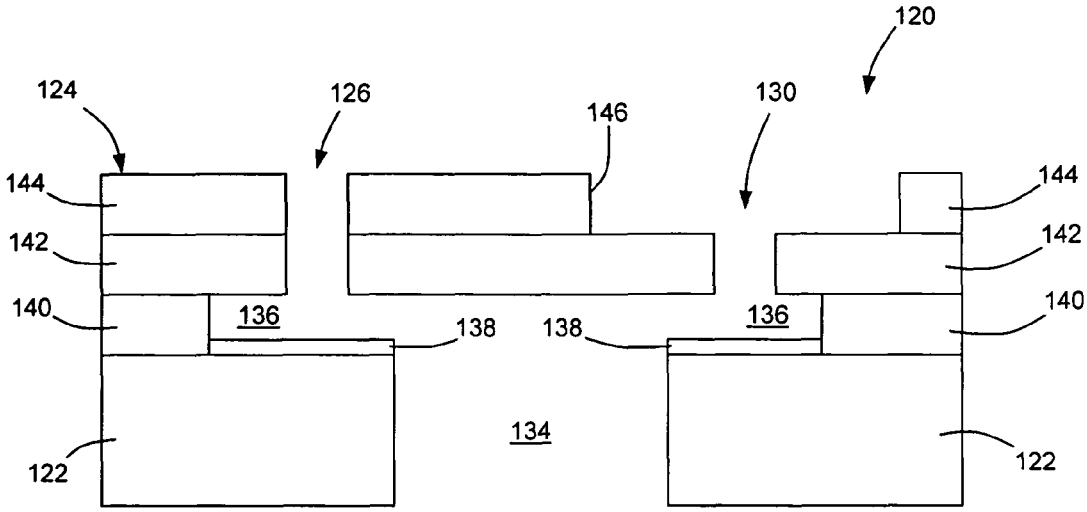
FIG. 4 is a cross-sectional view of an embodiment of the printhead taken along line 4-4 of FIG. 3.
Figure 5:
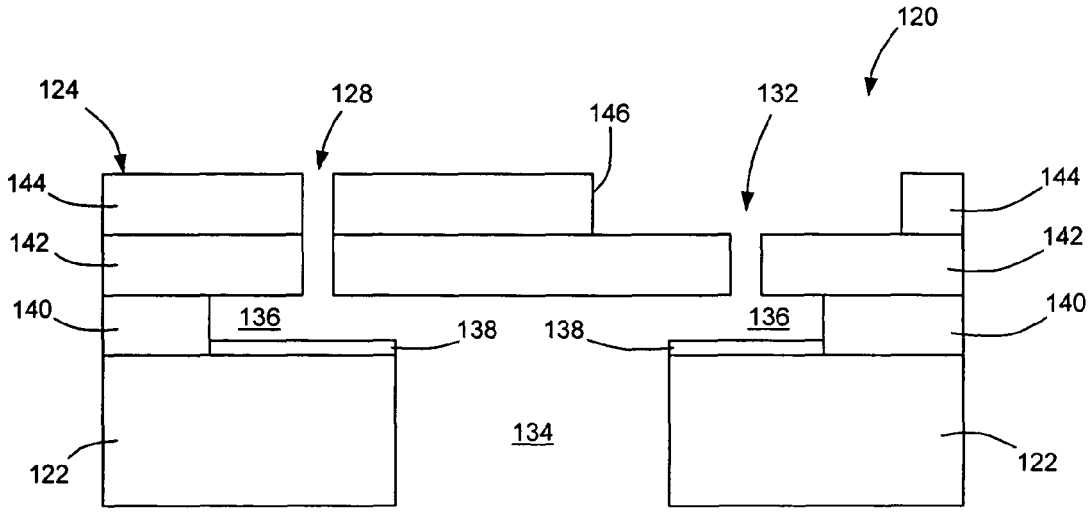
FIG. 5 is a cross-sectional view of an embodiment of the printhead taken along line 5-5 of FIG. 3.

Turning to FIGS. 3-5, one possible embodiment of the printhead 120 is depicted. The printhead 120 generally includes a substrate 122 and a fluidic layer assembly 124 disposed on top of the substrate 122. The substrate 122 is typically a single piece of a suitable material such as silicon, gallium arsenide, glass, silica, and the like. The fluidic layer assembly 124 has four nozzles formed therein: a first nozzle 126, a second nozzle 128, a third nozzle 130 and a fourth nozzle 132. It should be noted that four nozzles are shown only by way of example and that any number of nozzles could be provided. At least one fluid feed hole 134 is formed in the substrate 122, and the nozzles are arranged around the fluid feed hole 134. In the illustrated embodiment, the first and second nozzles 126, 128 are arranged on one side of the fluid feed hole 134, and the third and fourth nozzles 130, 132 are arranged on the other side of fluid feed hole 134. Although FIGS. 3-5 depict one common printhead configuration, namely, two rows of nozzles about a common ink feed hole, other configurations may also be used with the present invention.

Associated with each nozzle is a firing chamber 136 that is in fluid communication with the fluid feed hole 134. A fluid ejector 138 is located in each firing chamber 136 and functions to eject drops of fluid through the corresponding nozzle. In one embodiment, the fluid ejectors 138 can be heat-generating elements such as resistors so that the printhead 120 is a thermal inkjet printhead. In a thermal inkjet printhead, the heat-generating elements heat the ink in the firing chamber to cause drop ejection. The present invention is advantageous for thermal inkjet printheads, however, other types of fluid ejectors, such as piezoelectric actuators, can also be used. To eject a droplet from one of the nozzles, fluid is introduced into the associated firing chamber 136 from the fluid feed hole 134. The associated fluid ejector 138 is activated to eject a droplet through the corresponding nozzle. The firing chamber 136 is refilled after each droplet ejection with fluid from the fluid feed hole 134.

The nozzles 126, 128, 130, 132 and the firing chambers 136 are formed in the fluidic layer assembly 124, which is fabricated as multiple layers: a chamber layer 140 disposed on the substrate 122, a first orifice layer 142 disposed on the chamber layer 140, and a second orifice layer 144 disposed on the first orifice layer 142. (As used herein, the term "disposed on" does not necessarily mean directly on top of; the also encompasses being indirectly on top of a layer with intermediate layers provided therebetween.) The firing chambers 136 are formed in the chamber layer 140, and each of the nozzles 126, 128, 130, 132 is formed in one or both of the orifice layers 142, 144. While the illustrated embodiment shows two orifice layers, it should be noted that the present invention could include more than two orifice layers. Also, it should be noted that the chamber layer could be made of more than a single film.

Each nozzle 126, 128, 130, 132 has a different geometry for ejecting droplets of different drop weights. Generally, larger drop weights are achieved by employing both orifice layers 142, 144 to create a full-thickness nozzle orifice, while smaller drop weights are achieved by using only the first orifice layer 142 to create the usable orifice. In addition, orifice diameter and/or fluid ejector size can be varied to provide different drop weights. By using different geometries, the drop weight between nozzles can be varied by as much as a factor of about 5-10. That is, the drop weight produced by one nozzle can be about 5-10 times greater than the drop weight produced by another nozzle.

In the illustrated embodiment, the first nozzle 126 produces the largest drop weight, the second nozzle 128 produces the second largest drop weight, the third nozzle 130 produces the third largest drop weight, and a fourth nozzle 132 produces the smallest drop weight. As shown in FIG. 4, the first nozzle 126 comprises orifices of a relatively large diameter formed through both orifice layers 142, 144. This provides a full-thickness nozzle having a large cross-sectional area. The second nozzle 128, as shown in FIG. 5, also comprises orifices formed through both orifice layers 142, 144, but these orifices have a slightly smaller diameter than the first nozzle 126. The second nozzle 128 thus has a smaller cross-sectional area and produces a smaller drop weight than the first nozzle 126 (because the volume of fluid above the fluid ejector 138 is smaller, the drop volume ejected by the second nozzle 128 is correspondingly smaller).

Referring again to FIG. 4, the third nozzle 130 comprises an orifice formed through the first orifice layer 142 only. This is accomplished by providing a counterbore 146 in the second orifice layer 144 centered over the orifice in the first orifice layer 142 so that the third nozzle 130 is coincident with the counterbore 146. The counterbore 146 is large enough (e.g., 3-4 times larger than the nozzle orifice) to ensure that only the first orifice layer 142 participates in the drop ejection and refill mechanisms. In other words, the counterbore 146 should be large enough so as to not function as a nozzle. The third nozzle 130 is consequently not as long or deep as the first and second nozzles. The diameter of the third nozzle 130 is set so that the fluid capacity of the third nozzle 130 is less than that of the second nozzle 128 and the third nozzle 130 produces a smaller drop weight than the second nozzle 128. This can be accomplished with the diameter (and hence the cross-sectional area) of the third nozzle 130 being substantially equal to, or even slightly greater than, the diameter of the second nozzle 128 because of its shorter length. In the illustrated example, the diameter of the third nozzle 130 is substantially equal to the diameter of the first nozzle 126 and slightly greater than the diameter of the second nozzle 128, but the third nozzle 130 produces droplets having a lesser drop weight because of the counterbore 146.

The counterbore 146 is also large enough to allow effective wiping of the nozzle 130. For instance, the counterbore 146 will not hinder the serviceability of the printhead 120 when the printhead is used in an inkjet printer having a service station; the printhead 120 will still be able to be serviced without undue risk of delaminating.

As shown in FIG. 5, the fourth nozzle 132 is also formed through the first orifice layer 142 only because of another counterbore 146 formed in the second orifice layer 144 coincident therewith. However, the fourth nozzle 132 has a slightly smaller diameter than the third nozzle 130, so that the fourth nozzle 132 has a smaller cross-sectional area and produces a smaller drop weight than the third nozzle 130.

The foregoing describes the printhead 120 as having four nozzles that produce four different drop weights. However, as stated above, the present invention is not limited to four nozzles and could have many more than four nozzles. In which case, different drop weights would be achieved by varying nozzle diameters and selectively providing counterbores to some of the nozzles. In addition, the printhead 120 could have more than two orifice layers, with varying depths of counterbores formed therein to provide further differentiation of drop weights between nozzles. For instance, the printhead 120 could have a first orifice layer disposed on the chamber layer, a second orifice layer disposed on the first orifice layer, and a third orifice layer disposed on the second orifice layer. Some of the nozzles would be formed through all three of the orifice layers. Other nozzles would be formed through the first and second orifice layers with a counterbore formed in the third orifice layer. Still other nozzles would be formed through the first orifice layer with a counterbore formed in the second and third orifice layers. Further orifice layers could be provided in the same manner. Moreover, although each nozzle is shown has having a unique geometry for producing a unique drop weight, it should be noted that the printhead 120 could be provided with groups of nozzles that produce certain drop weights. For example, 3 or 4 nozzles that all produce droplets having a first drop weight, 3 or 4 nozzles that all produce droplets having a second drop weight, and so on.

In one embodiment, the orifice layers 142, 144 can be formed from a dryfilm material, such as a photopolymerizable epoxy resin known generally in the trade as SU8, which is available from several sources including MicroChem Corporation of Newton, Mass. SU8 is a negative photoresist material, meaning the material is normally soluble in developing solution but becomes insoluble in developing solutions after exposure to electromagnetic radiation, such as ultraviolet radiation. In this case, fabrication of the orifice layers 142, 144 comprises first applying a layer of photoresist material to a desired depth over the chamber layer 140, which has previously been fabricated on the substrate 122, to provide the first orifice layer 142. The open portions of the chamber layer 140 defining the firing chamber 136 are temporarily filled with a sacrificial fill material.

The first orifice layer 142 is then imaged by exposing selected portions to electromagnetic radiation through an appropriate mask, which masks the areas of the first orifice layer 142 that are to be subsequently removed and does not mask the areas that are to remain. The areas of the first orifice layer 142 that are to be removed correspond to the portions of the first orifice layer 142 that will define nozzles. The first orifice layer 142 is typically not developed at this point in the process.

Next, another layer of photoresist material is applied to a desired depth over the first orifice layer 142 to provide the second orifice layer 144. The second orifice layer 144 is then imaged by exposing selected portions to electromagnetic radiation through an appropriate mask, which masks the areas of the second orifice layer 144 that are to be subsequently removed and does not mask the areas that are to remain. The areas of the first orifice layer 142 that are to be removed correspond to the portions of the first orifice layer 142 that will define nozzles or counterbores.

After the first and second orifice layers 142, 144 have been exposed, they are jointly developed (using any suitable developing technique), to remove the unexposed, soluble bore layer material and leave the exposed, insoluble material. In addition, the fill material filling the chamber layer 140 is also removed. It should be noted that positive photoresist materials could alternatively be used. In this case, the mask patterns used in the photoimaging steps would be reversed. Furthermore, although the first and second orifice layers 142, 144 are shown in FIGS. 4 and 5 has having equal thickness, these layers could have different thicknesses as well. For example, the first orifice layer 142 could have a thickness in the range of about 20-30 microns, and the second orifice layer 144 could have a thickness in the range of about 1-2 microns.

The printhead 120 provides many drop weights on a single die to enable the ejection of multiple drop sizes out of the same common fluid reservoir. When used in the fluid-dispensing device 100, or any other stand-alone device for accurately dispensing small amounts of various fluids in a laboratory setting, the printhead 120 allows easy exploration of fluid space without wasting a large amount of fluid. For example, the chamber 114 of a single pen 102 could be filled with the particular fluid to be ejected. The user would then operate the fluid-dispensing device 100 to eject droplets of the fluid from some or all of the nozzles and then determine which one of the nozzles produced the droplet having the desired drop weight. This provides much faster convergence onto the proper design needed to obtain the desired drop volume or line width for a particular application or substrate. Unlike traditional inkjet imaging applications, which typically fire at very high frequencies generally making the use of more than two drop weights impractical, use in a stand-alone fluid-dispensing device in a laboratory setting is well suited for a multiple drop weight printhead. Nevertheless, while particularly useful in laboratory fluid-dispensing devices, the multiple drop weight printhead 120 could be useful in other applications, including traditional inkjet printing.

While specific embodiments of the present invention have been described, it should be noted that various modifications thereto can be made without departing from the spirit and scope of the invention as defined in the appended claims.

What is claimed is:

1. A printhead comprising:

a chamber layer;

a first orifice layer disposed on said chamber layer;

a second orifice layer not part of a same layer as said first orifice layer is, and disposed on said first orifice layer, said second orifice layer having a counterbore formed therein, said second orifice layer being separately exposed as compared to said first orifice layer but jointly developed with said first orifice layer;

a first nozzle formed through said first and second orifice layers, said first nozzle producing droplets of a first drop weight; and a given nozzle formed through said first orifice layer coincident with said counterbore, said given nozzle producing droplets of a second drop weight that is different than said first drop weight, where the given nozzle is different than the first nozzle.

2. The printhead of claim 1 wherein said first drop weight is about five times greater than said second drop weight.

3. The printhead of claim 1 wherein said first drop weight is about ten times greater than said second drop weight.

4. The printhead of claim 1 wherein said first nozzle and said given nozzle have cross-sectional areas that are substantially equal.

5. The printhead of claim 1 further comprising a third nozzle formed through said first and second orifice layers, said third nozzle producing droplets of a third drop weight that is different than said first and second drop weights.

6. The printhead of claim 5 wherein said third nozzle has a smaller cross-sectional area than said first nozzle so that said third drop weight is less than said first drop weight.

7. The printhead of claim 1 wherein said second orifice layer has an additional counterbore formed therein and further comprising a third nozzle formed through said first orifice layer coincident with said additional counterbore, said third nozzle producing droplets of a third drop weight that is different than said first and second drop weights.

8. The printhead of claim 7 wherein said third nozzle has a smaller cross-sectional area than said given nozzle so that said third drop weight is less than said second drop weight.

9. The printhead of claim 1 wherein said second orifice layer has an additional counterbore formed therein and further comprising a third nozzle formed through said first and second orifice layers, said third nozzle producing droplets of a third drop weight that is different than said first and second drop weights, and a fourth nozzle formed through said first orifice layer coincident with said additional counterbore, said fourth nozzle producing droplets of a fourth drop weight that is different than said first, second and third drop weights.

10. The printhead of claim 9 wherein said third nozzle has a smaller cross-sectional area than said first nozzle so that said third drop weight is less than said first drop weight and said fourth nozzle has a smaller cross-sectional area than said given nozzle so that said fourth drop weight is less than said second drop weight.

11. The printhead of claim 1 wherein said chamber layer includes first and second firing chambers, said first nozzle being in fluid communication with said first firing chamber and said given nozzle being in fluid communication with said second firing chamber.

12. The printhead of claim 11 further comprising a fluid ejector disposed in each firing chamber.

13. The printhead of claim 12 wherein each fluid ejector is a heat-generating element.

* * * * *